US005376342A

United States Patent [19]

Waite

[11] Patent Number: 5,376,342

[45] Date of Patent: Dec. 27, 1994

[54] PROCESS FOR RECOVERING ZINC PHOSPHATING MAKE-UP FEED FROM ZINC PHOSPHATE SLUDGE

[76] Inventor: Michael D. Waite, 20749 Parkwood La., Strongsville, Ohio 44136

[21] Appl. No.: 45,375

[22] Filed: Apr. 9, 1993

[51] Int. Cl.[5] ..... C23C 22/07

[52] U.S. Cl. ..... 423/109; 423/99; 423/101; 423/102; 423/142; 423/592

[58] Field of Search ..... 423/592, 101, 102, 142, 423/99, 109

[56] References Cited

U.S. PATENT DOCUMENTS

| | | | |
|---|---|---|---|
| 4,515,643 | 5/1985 | Knaster | 148/6.15 Z |
| 4,597,806 | 7/1986 | Hauffe | 148/6.15 Z |
| 4,968,360 | 11/1990 | Hosemann et al. | 148/253 |
| 4,986,977 | 1/1991 | Peters | 423/592 |

FOREIGN PATENT DOCUMENTS 1397408 3/1988 U.S.S.R. .

*Primary Examiner*—Michael Lewis
*Assistant Examiner*—Wendy D. Lovern
*Attorney, Agent, or Firm*—Fay, Sharpe, Beall, Fagan, Minnich & McKee

[57] ABSTRACT

A process for recycling a zinc phosphating system sludge comprising forming a mixture of the sludge with water and phosphoric acid. The mixture is formed at an elevated temperature and a pH of between 1.5 and 2.4. The sludge substantially dissolves in the mixture and iron phosphate precipitates out. The resultant liquid comprises a substantially zinc ion and phosphate ion solution suitable for use as a make-up feed in zinc phosphating system.

22 Claims, No Drawings

PROCESS FOR RECOVERING ZINC PHOSPHATING MAKE-UP FEED FROM ZINC PHOSPHATE SLUDGE

BACKGROUND OF THE INVENTION

Field of the Invention

This invention relates to a process for recovering useable products from the waste of phosphating systems. Particularly, the recovered products are capable of use as make-up feed in a zinc phosphating process. More particularly, this invention relates to a process of treating zinc phosphating system sludge with phosphoric acid to precipitate iron phosphate and allow recovery of a useable zinc phosphate solution.

The process of the invention is particularly well suited for use as a continuous process of removing sludge waste from a zinc phosphating operation, dissolving the sludge in water and phosphoric acid, precipitating iron phosphate from the solution, removing the iron phosphate precipitate and recycling the resultant zinc phosphate solution to the zinc phosphating operation as a make-up feed.

Throughout the specification, numerous references will be made to the use of sludge from a zinc phosphating process. However, it should be realized that the invention could be used in the treatment of any sludges containing iron and zinc phosphates. For example, nickel plating waste and carbon steel flue dust are treatable by this process to recover valuable products.

Description of Art

Many commercial painting operations use a zinc phosphating system to provide a superior corrosion barrier and enhanced adhesion of a coating to the steel substrate. For example, in automobile assembly plants a solution of mono-basic zinc phosphate, phosphoric acid, and nickel or cobalt is used to dip or spray the metal to increase corrosion resistance and paint adhesion. Zinc phosphating operations require aqueous solutions of phosphate ions, and metallic ions such as zinc. The operation requires regular replenishment of the solution with concentrated make-up feed. During normal operation, phosphate systems continuously produce an insoluble precipitant. This material (commonly referred to as sludge) interferes with the operation of a phosphate system and must be periodically removed. Typically, zinc phosphate sludge, having no alternative use, is discarded via land fills.

Large quantities of waste phosphate sludge result from industrial phosphating operations. Zinc phosphate sludge is a mixed iron/zinc salt of phosphoric acid believed to have the general formula: $ZnFe_{7/3}(PO_4)_3$. This material is often referred to as phosphophylite. Zinc phosphate sludge usually contains primarily iron, phosphorous, and zinc, and lesser amounts of metals such as manganese, nickel and cobalt. A typical sludge might be comprised of 17 to 23% by weight iron, 12 to 19% by weight phosphorus, 5 to 11% by weight zinc and less than 3% by weight other metals. Often, the percentage of iron present in the sludge is nearly twice the percentage of zinc; however, occasionally, iron and phosphorous appear in higher percentages. Generally, this occurs because iron phosphate ($FePO_4$) is trapped in conjunction with the phosphophylite.

Sludges are generally very fine grain and often include small amounts of scale or other large grain debris and organic matter. It is estimated that fifty million pounds of sludge result from phosphating operations each year. Accordingly, it is desirable to find a means for recovering various sludge components.

U.S. Pat. No. 3,653,875 discloses a process for recovery of constituents of a waste phosphate sludge by mixing the sludge with an alkali solution, drying the mixture and sintering it at a temperature of from about 500° to 1300° C. in the presence of a reductant. This process converts the phosphate in the sludge to a water soluble phosphate salt, reduces the zinc and iron to their metallic state and volatilizes the zinc from the reaction zone. Leaching the sinter cake with water recovers the soluble phosphate and the iron. This is an energy intensive recovery process requiring heating up to 1300° C. Accordingly, its value as a recycling process is reduced. In addition, this process can take up to one day to complete. This time requirement is not conducive to a continuous recycling process.

U.S. Pat. No. 4,986,977 discloses a process for recovery of the constituents of phosphate sludge comprising treating the sludge with an aqueous base to achieve a pH of greater than 10 and the resultant precipitation of iron hydroxide. The iron hydroxide is recovered and the aqueous phase acidified to a pH range of 7 to 10 to cause precipitation of zinc hydroxide. The process is complicated and time intensive. Furthermore, the recovered iron phase is contaminated with heavy metals (Ni, Co, Mn). This makes the iron phase unsuitable for use as an animal feed and unattractive for landfill disposal. In addition, it prohibits the recovery of the valuable heavy metals for other uses.

Accordingly, it is necessary in this art to have a cost effective process to recover metals and phosphate from phosphating sludge. Furthermore, it is desirable to have a process efficient enough to be operated continuously.

Summary of the Invention

Accordingly, it is a primary object of this invention to provide a new and improved process for recovering metals and phosphates from phosphating operation sludge.

It is a further object of this invention to provide a new and improved process that is capable of recovering a zinc and phosphate solution, useable as zinc phosphating operation make-up feed, from phosphating sludge.

It is still a further object of this invention to provide a new and improved process for recovering zinc, iron, and phosphate from zinc phosphating operation sludge.

It is an additional object of this invention to provide a new and improved process for recovering zinc, iron and phosphate from zinc phosphating operation sludge in a short period of time and at low cost.

Additional objects and advantages of the invention will be set forth in part in the description which follows and in part will be obvious from the description, or may be learned by practicing the invention. The objects and advantages of the invention may be realized and obtained by means of the instrumentalities and/or combinations particularly pointed out in the appended claims.

To achieve the foregoing objects and in accordance with the purpose of the invention, as embodied and broadly described herein, the process of this invention comprises dissolving a waste phosphate sludge comprising at least zinc, iron and phosphate in water and phosphoric acid. The mixture formed by this dissolution yields an iron oxide precipitant. The iron oxide precipitant and the liquid phase are separated. The liquid phase comprises high levels of zinc and phosphate suitable for use as a make-up feed in zinc phosphating processes. Preferably, the mixture comprised of water, phosphoric acid, iron, zinc, and phosphate has a pH of between about 1.5 and 2.4, more preferably between about 1.8 and 2.1. Most preferably, the pH of the mixture is about 2.0.

The mixture is preferably maintained at about its boiling temperature. More preferably, the temperature is between about 90° C. and 100° C., most preferably between about 95° C. and about 100° C. Preferably, subsequent to formation of the mixture, but prior to any substantial precipitation of the iron phosphates, undissolved materials are removed from the system.

Preferably, the liquid comprising zinc and phosphate has a zinc level of at least 30,000 parts per million, and more preferably between about 40,000 and 60,000 parts per million. Furthermore, preferably the liquid comprises between about 240,000 and 300,000 parts per million phosphate.

DETAILED DESCRIPTION OF THE INVENTION

While the inventive process will be described in connection with a preferred embodiment or procedure, it will be understood that is not intended to limit the invention to that procedure. On the contrary, it is intended to cover all alternatives, modifications and equivalents which may be included within the spirit and scope of the invention defined by the appended claims.

Four primary operations comprise the current recycling process. 1) Digestion; the dissolution of the sludge. 2) Unrecoverable removal; the filtration of undissolved solids. 3) Precipitation; the precipitation and recovery of iron phosphate. 4) Reformulation; addition of requisite metals to the zinc and phosphate containing aqueous phase. Each step is not required to obtain the objects of the invention, however, performing these steps together is a preferred mode of operation.

Digestion

Zinc phosphate sludge is usually removed from the phosphate system as a wet powder. Water is added to the sludge to achieve the correct concentration of the dissolved solids in the solution. The primary limitation regarding solids content is the flowability of the solution. A high solids content is desirable for efficient, high zinc and phosphate recovery however, the solution is preferably pumpable to facilitate processing. The water used for this purpose is preferably free of potential contaminants. Distilled water, deionized water, or reverse osmosis water is generally recommended. An agitated vessel is used to combine the water and solids. Slurrification of the sludge solids may be done continuously or in batches. Occasionally, sludge is removed from a phosphate system as a slurry. In such cases, the sludge solids and water require little, if any, premixing and may be pumped to a digestion vessel immediately.

Slurrified phosphate sludge generally has a practical limit of 33% solids to maintain its pumpable characteristic. Depending on the zinc content of the sludge, the amount of available zinc may be insufficient. For example, in at least one instance, 33% solids was found to limit the available zinc to about 3.5% of the raw liquid product. Most commercial zinc phosphate formulas contain at least 4% zinc. The zinc concentration may be raised by recycling some fraction of the raw zinc aqueous product to the digester. This lowers the solids content of the slurry in the digester while raising the zinc content of the solution phase. Zinc concentrations up to 5.5% have been achieved by this method and higher concentrations are certainly possible.

Another method of enriching the raw zinc solution is to incorporate the scale produced in phosphating operations. Scale is a hard layer on the heat transfer surfaces of the phosphating tank. When removed, scale exists as chips and granules of widely varying size. Scale is usually crushed to small pieces of less than 5 millimeters prior to processing. This material is very rich in zinc and other non-ferrous metals. Normally, phosphate operation scale contains much less iron than the sludge. Adding scale to the slurry raises the zinc content considerably. The aqueous recycling method of enriching the raw zinc product and the scale method may be used separately or in combination.

Digestion is accomplished by preheating the slurry to its boiling point under agitation and then introducing phosphoric acid. When the heated slurry is mixed with acid, dissolution of the slurrified sludge occurs almost immediately. Alternatively, a mixture of water and phosphoric acid can be prepared and dry sludge or partially slurrified sludge added to the acidic water solution. Again, the solution and/or mixture is preferably heated and agitated.

Although any strength phosphoric acid can be utilized in the process, good results have been obtained when 85% phosphoric acid comprises between about 40 and 100% of the dry weight of the sludge. A more precise means of determining the appropriate quantity of phosphoric acid is by pH levels. Particularly, the mixture of sludge, water and phosphoric acid preferably has a pH level of between 1.5 and 2.4. More preferably, the pH level is between about 1.8 and 2.1. Most preferably, the pH is about 2.0. The pH level is significant because zinc phosphate and zinc phosphate sludge (phospholylite) are soluble in these ranges. However, iron phosphate does not remain dissolved in a phosphoric acid solution at these pH levels. During digestion, phosphate sludge dissolves into aqueous solution. Thereafter, iron is forced to precipitate as iron phosphate. In this way, the iron spontaneously separates from the zinc bearing liquid phase.

Elevated temperature is also beneficial to the process. Particularly, the rate of dissolution of the sludge increases as the temperature of the digestion mix is increased. In addition, iron phosphate is less soluble at higher temperatures while zinc phosphate is more soluble at high temperatures. Also, an elevated temperature encourages the coagulation of the generally very fine sol particles of iron phosphate. Coagulation facilitates the filtration of the iron phosphate from the liquid phase.

Although trivalent iron is not generally soluble in aqueous phosphoric acid solutions, its solubility increases as pH decreases. Accordingly, it is desirable to maintain pH levels above 1.5 to prevent accumulation of an unacceptable iron level in the aqueous phase. Furthermore, excessive acid levels produce a raw zinc product with a correspondingly high acid content. A high acid level raw zinc product tends to be incompatible with the formulation used for most commercial zinc phosphate solutions. This complicates the reformulation step. In the alternative, too high of a pH level results in an incomplete digestion of zinc phosphate sludge. A partially digested sludge mixture becomes extremely thixotropic. In that state, the digestion mixture becomes difficult to agitate or pump. It should be noted that even a properly digested slurry contains small amounts of unrecoverable material comprising bits of undissolved sludge, organic oil, iron oxide particles, and miscellaneous dirt.

Unrecoverable Removal

The undissolved materials are removed by passing the digested sludge through suitable filter media. Gravity filtering, vacuum assisted filtering, and centrifugal filtering have been used successfully. The filtered unrecoverable must be discarded.

Iron phosphate precipitates may be removed either in combination with the other miscellaneous undissolved dirt or preferably in a two step process in which the miscellaneous dirt etc. is removed promptly after the dissolution of the sludge, yet prior to substantial iron phosphate precipitation. By removal of the contaminants early, the iron phosphate which precipitates later may be used as an animal feed additive.

Iron Precipitation

Iron is separated from the zinc-bearing aqueous phase by precipitation of iron phosphate product. The predominant reaction to precipitate iron is characterized by the following: $ZnFeT_{7/3}(PO_4)_3(s) \xrightarrow{\Delta} 7FePO_4(s) + Zn_3(PO_4)_2(aq)$. Spontaneous iron precipitation begins within 2 to 3 minutes after digestion. The mixture preferably has a vessel residence time of at least 2 hours. Since iron precipitation is more rapid and complete at high temperature, the vessel should be heated, preferably to between about 90° C. and 100° C., and agitated. More preferably, the vessel contents should be at a temperature sufficient to achieve a gentle boiling. Water loss is prevented by condensation and refluxing of water vapor.

Excess phosphoric acid present in the raw zinc liquid product allows for the presence of soluble iron, accordingly, the amount of residual iron may sometimes be deemed unacceptable. Undesirable iron may be substantially removed by dissolving soluble trivalent iron compounds in the zinc-bearing, aqueous phase. The introduction of additional iron disturbs the equilibrium and forces precipitation of the added iron as iron phosphate. Trivalent iron may be added as hydrated iron oxide $Fe(OH)_3$ in water. The reaction generally proceeds as follows: $Fe(OH)_3(s) + H_3PO_4(aq) \xrightarrow{\Delta} FePO_4(s) + 3H_2O$. The precipitation also acts to lower the free acid level by removal of phosphate ions with the iron. The reduced free acid level forces precipitation of more iron and ultimately lowers the iron content of the raw zinc-bearing aqueous phase.

Iron may also be added as a nitrate or in another soluble form compatible with commercial zinc phosphate solutions. Metallic iron powder provides a low cost alternative. If iron metal is used, the solution will contain divalent iron and should be treated with hydrogen peroxide (or some other compatible oxidizer) to form the trivalent iron ion. Generally, the above steps are performed as necessary to produce a zinc phosphate liquid phase comprising less than 5,000 ppm iron. More preferably, the zinc phosphate phase comprises less than 2,000 ppm and most preferably less than 1,000 ppm of iron.

Reformulation

To insure the raw zinc solution is a useful makeup feed, it may be treated with an additive package. The additives allow the makeup feed to be made substantially equivalent to the original zinc phosphating solution. Commercial zinc phosphate solutions normally contain additional non-ferrous metals. Typical metals are nickel, manganese, and cobalt. Due to higher solubilities, these metals will tend to be found in the raw zinc solution at a lower concentration than in the corresponding make-up feed.

The additive package will usually contain non-ferrous metals. These metals may be introduced as finely divided powders, as oxides, or as compatible salts such as phosphates. Heat and agitation often facilitate the rapid and complete dissolution of the additives.

Preferably, the entire process will be carried out in a continuous system. In such a system, it is envisioned that sludge will be continuously added to a water and phosphoric acid mixture. Sludge contents can be monitored by measuring electrical conductivity of the mixture. Thus, the level of metal ions in the system control the addition of sludge. In addition, the system can be monitored to determine the pH level. Accordingly, additional phosphoric acid or water can be added to achieve the above preferred pH levels.

Preferably, this process will produce a liquid make-up feed material having a zinc content of at least 30,000 parts per million. More preferably, the liquid will have a zinc content of between 40,000 and 60,000 parts per million. Additionally, the liquid will contain at least 240,000 parts per million phosphate. More preferably, the liquid will contain from about 240,000 parts per million to about 300,000 parts per million phosphate.

If a make-up feed with heavy metals is not required, one of ordinary skill in the art will be capable of further treatment of the aqueous phase to remove metals such as cobalt or nickel.

The process is designed either as a continuous process or as a batch process to provide the sludge mixture with a 2 to 4 hour residence time at the requisite pH, temperature and agitation levels.

Additionally, it is envisioned that this invention will facilitate the further treatment of the iron phosphate precipitant to produce iron oxide and phosphoric acid. The phosphoric acid can be recycled for reuse in this process. The iron oxide can be treated with hydrochloric acid to form useful iron chlorides.

Various aspects of the invention will now be illustrated with several examples.

EXAMPLE 1

Two hundred grams of a zinc phosphate sludge containing 23% solids were agitated and heated to boiling in a flask with a reflux of water vapor. Forty two grams of 85% phosphoric acid were added under agitation. The digested mixture was immediately filtered by gravity filtration through standard filter paper to remove miscellaneous unrecoverable solids. The solution was then agitated and simmered with reflux for 10 hours. After cooling under agitation for approximately three hours, the mix was again filtered to separate the iron phosphate solids. I.C.P (inductively coupled plasma) elemental analysis showed an acceptable zinc phosphate makeup solution had been recovered.

| | Dry Sludge | Iron Phosphate Solid | Zinc Phosphate Liquid |
|---|---|---|---|
| Zn | 56,534 | 5,623 | 11,602 |

-continued

| | Dry Sludge | Iron Phosphate Solid | Zinc Phosphate Liquid |
|---|---|---|---|
| Fe | 197,730 | 258,971 | 958 |
| $PO_4$ | 393,892 | 464,878 | 149,738 |
| Co | 3,263 | 135 | 617 |

The zinc phosphate liquid may be reformulated to a finished zinc phosphate product by addition of zinc, phosphate, and cobalt. The iron phosphate solid is suitable for use as an iron and phosphorus source in animal feed.

EXAMPLE 2

Fifty grams of dry zinc phosphate sludge containing 1% water was mixed with 100 grams of distilled water to produce a slurry. The mixture was heated to boiling under agitation and with reflux of water vapor. Fifty grams of 85% phosphoric acid were added carefully while under agitation. The sludge immediately dissolved to produce a solution containing some undigested solids.

The mix was simmered under agitation and reflux for four hours. After cooling under agitation and reflux, the mix was filtered to removed all solids. A sample of the zinc bearing liquid was retained. The zinc-bearing liquid product was reheated to boiling with agitation and reflux. Iron was added to the solution by dissolution of 3.0 grams of iron powder. After the iron was dissolved, two drops of 30% hydrogen peroxide were added. The solution was simmered under agitation and reflux for four hours to precipitate iron. After cooling, the iron phosphate solid was removed by filtration. The liquid was retained and I.C.P. elemental analysis showed a very acceptable makeup feed having a preferred zinc to iron ratio.

| | First Zinc Product | Second Zinc Product |
|---|---|---|
| Zn | 34,800 | 36,000 |
| Fe | 8,060 | 2,480 |
| $PO_4$ | 294,678 | 259,794 |

The second zinc product had reduced iron and may be converted to a commercial zinc phosphate solution by addition of a small amount of zinc oxide.

EXAMPLE 3

One hundred grams of zinc phosphate sludge containing about 93% solids were slurrified to 33% solids using distilled water. The slurry was heated to boiling under agitation and reflux of the water vapor. The slurry was digested with 100 grams of 85% phosphoric acid. Undigestible solids were separated from the mixture by immediately filtering through standard filter paper with the aid of a partial vacuum. The filtrate was simmered under reflux and agitation for several hours to precipitate iron phosphate.

The raw zinc product was further treated by addition of 3.5 grams of iron powder. After the iron was dissolved, 3 drops of 30% hydrogen peroxide were added. Again the mix was simmered four hours with reflux and agitation. After cooling, the mix was filtered to remove the iron product. Analysis by I.C.P. spectroscopy shows a very acceptable zinc phosphate makeup solution.

| | ICP Elemental Analysis (ppm) | | |
|---|---|---|---|
| | Dry Sludge | Iron Product | Zinc Product |
| Zn | 91,500 | 2,776 | 32,710 |
| Fe | 171,500 | 182,406 | 2,930 |
| $PO_4$ | 489,600 | 532,455 | 230,424 |
| Mn | 23,250 | 749 | 4,978 |
| Ni | 2,000 | 31 | 876 |

This zinc product may be converted to a commercial zinc phosphate solution by addition of small amounts of zinc, phosphate, manganese, and nickel. The iron product is suitable for use as an iron and phosphorus source in animal feed.

EXAMPLE 4

One hundred grams distilled water were acidified with 20 grams of 85% phosphoric acid. The solution was heated to boiling with agitation and reflux of vapors. Twenty grams of dry zinc phosphate sludge were admixed under agitation and dissolved immediately. The mix was simmered one hour with agitation and reflux. Ten grams of sludge were added under agitation and simmered for one hour with reflux. Another ten grams of sludge were added under agitation and simmered for one hour. Still another ten grams of sludge were added Under agitation and simmered for 2 to 3 hours. Finally, the mix was cooled for 4 hours under agitation and reflux.

The solid was removed by gravity filtration through standard filter paper. The solid phase was thoroughly washed and gently dried at 100° F. After 24 hours, the liquid phase was refiltered. Approximately 145 grams of liquid product and 25 grams of solid product were produced. I.C.P. elemental analysis showed the following results.

| | Dry Sludge | Zinc Product | Iron Product |
|---|---|---|---|
| Zn | 111,199 | 34,804 | 14,392 |
| Fe | 230,281 | 1,310 | 345,669 |
| $PO_4$ | 553,707 | 226,287 | 604,827 |
| Mn | 13,864 | 4,257 | 2,411 |
| Ni | 5,027 | 2,079 | 525 |

The zinc product may be converted to a useful zinc phosphate solution by addition of a small amount of zinc, phosphate, manganese, and nickel.

EXAMPLE 5

One hundred grams of distilled water were mixed with 30 grams zinc phosphate sludge. Twenty grams of 85% phosphoric acid were added under agitation and the mixture was heated to boiling. The sludge was digested and iron phosphate precipitated. The mix was simmered one hour under agitation. The solid was removed by gravity filtration and was discarded. Thirty grams of zinc phosphate sludge and 4 grams of 85% phosphoric acid were added to the solution. The mix was reheated to boiling with agitation and reflux of vapors and was simmered for 2 hours.

The mixture was cooled 3 to 4 hours under agitation, the solid was again removed by filtration and discarded.

The liquid phase was retained and analysis revealed the following composition.

| | Dry Sludge | Zinc Product |
|---|---|---|
| Zn | 88,539 | 42,309 |
| Fe | 183,519 | 1,043 |
| $PO_4$ | 447,644 | 237,241 |
| Ni | 2,625 | 1,194 |

The zinc product may be converted to a useful zinc phosphate solution by the addition of a small amount of phosphoric acid.

EXAMPLE 6

Fifteen hundred fifty eight pounds of a zinc phosphate sludge containing 20% solids and 80% liquid was heated to 90° C. in an enclosed 316 stainless steel tank under agitation and reflux of vapors through a condenser. One hundred fifty six pounds of 85% phosphoric acid were admixed with the tank contents. The mixture was heated to boiling and simmered for four hours with agitation and reflux. After cooling for several hours, 280 pounds of zinc phosphate scale and 370 pounds of 85% phosphoric acid were added to the tank contents. The mixture was reheated to boiling and simmered for three hours. After cooling overnight, the solid material was removed by centrifugal filtration. The filter media had a nominal pore size of approximately 10 microns.

The solid phase was comprised of 500 pounds of filter cake containing 50% iron solids and 50% zinc containing liquid. This material was discarded. The liquid phase was retained and I.C.P. analysis revealed the following composition.

| | Zinc Product |
|---|---|
| Zn | 62,000 |
| Fe | 4,930 |
| $PO_4$ | 329,256 |
| Co | 2,080 |

This material is very concentrated and is suitable for use as a zinc phosphate makeup solution without significant additions. Some addition of purified water may be added to prevent spontaneous precipitation of solids.

Thus, it is apparent that there has been provided, in accordance with the invention, a process that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations which fall within the spirit and broad scope of the appended claims.

Having thus described the invention, it is claimed:

1. A process for recovering zinc and phosphate comprising dissolving a sludge comprising zinc, iron and phosphate in water and phosphoric acid to form a mixture having a pH between about 1.5 and 2.4, precipitating iron phosphate, and recovering a liquid comprising zinc and phosphate.

2. The process of claim 1, further comprising dissolving said sludge at an elevated temperature.

3. The process of claim 1, wherein said water and phosphoric acid comprise an acidic aqueous solution to which said sludge is added.

4. The process of claim 1, wherein said sludge and said water comprise a slurry to which said phosphoric acid is added.

5. The process of claim 1, wherein said mixture comprises a pH between about 1.8 and 2.1.

6. The process of claim 5, wherein said pH is about 2.0.

7. The process of claim 1, wherein said liquid comprises at least 30,000 parts per million of zinc.

8. The process of claim 7, wherein said liquid comprises between about 40,000 and about 60,000 parts per million zinc.

9. The process of claim 1, wherein said liquid comprises between about 240,000 and about 300,000 parts per million phosphate.

10. The process of claim 1, wherein waste phosphate scale is added to said mixture.

11. The process of claim 1, wherein non-ferrous metals are added to said liquid.

12. The process of claim 1, wherein said mixture is agitated.

13. The process of claim 12, wherein said mixture is agitated for between and about 2 and about 4 hours.

14. The process of claim 2, wherein said temperature is between and about 90° C. and 100° C.

15. The process of claim 2, wherein said temperature is at least the boiling point of said mixture.

16. The process of claim 1, further comprising removing undigested material from said mixture.

17. The process of claim 16, wherein said materials are removed by filtration.

18. The process of claim 1, further comprising adding iron to said mixture.

19. The process of claim 3 being continuous.

20. The process of claim 19 wherein an electrical conductivity of said mixture is monitored.

21. The process of claim 19 wherein a pH level of said mixture is monitored.

22. The process of claim 1 further comprising recovering from said liquid at least one metal selected from the group consisting of nickel, cobalt and manganese.

* * * * *